US005080239A

United States Patent [19]

Rowland

[11] Patent Number: 5,080,239

[45] Date of Patent: Jan. 14, 1992

[54] GOLF-CLUB HOLDER FOR USE WITH GOLF CARTS

[76] Inventor: Joseph W. Rowland, 162 Seton Rd., Verona, Pa. 15147

[21] Appl. No.: 663,550

[22] Filed: Mar. 4, 1991

[51] Int. Cl.[5] ..... A47F 7/00

[52] U.S. Cl. ..... 211/70.2; 273/32 E; 248/530

[58] Field of Search ..... 211/70.2; 206/315.2; 273/32 E, 32 H; 248/530

[56] References Cited

U.S. PATENT DOCUMENTS 1,443,230 1/1923 Luckett ..... 248/530

*Primary Examiner*—Robert W. Gibson, Jr.
*Attorney, Agent, or Firm*—W. D. Palmer

[57] ABSTRACT

Golf-club holder which supplements a normal golf bag and is particularly adapted for use with golf carts. The holder comprises an elongated rigid body which terminates as a spike at one end which is driven into the ground when using the holder. Golf-club retaining means are affixed to the body and spaced from the spike so that the clubs can be retained proximate the upper ends thereof. The retaining means each have a short flexible member affixed at one end to the body and a ring-like retaining member is affixed to the other end. The ring-like member fits over the top of the club to retain same. When the holder is not in use it can readily be stored in the golf bag since it occupies only a small lateral space. In use, the golfer carries the holder and several clubs from the cart to a location remote from the cart where the clubs not used for the shot are retained by the holder. This keeps the clubs clean and dry and prevents clubs from being inadvertently left on the course.

13 Claims, 2 Drawing Sheets

FIG. 5
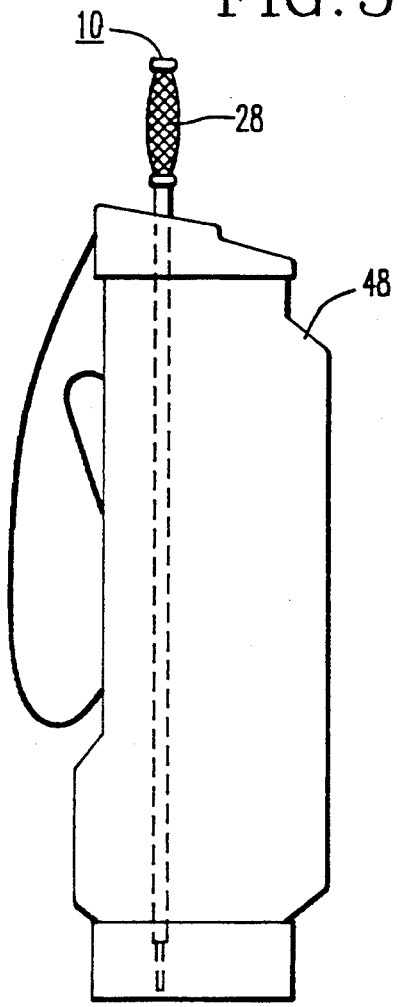
FIG. 4
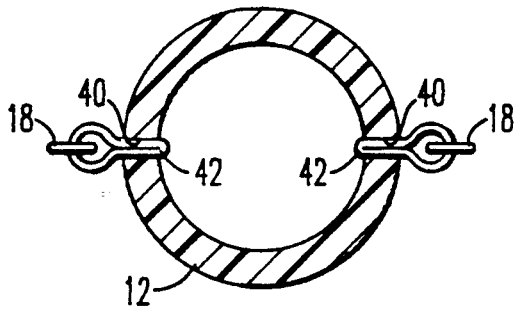
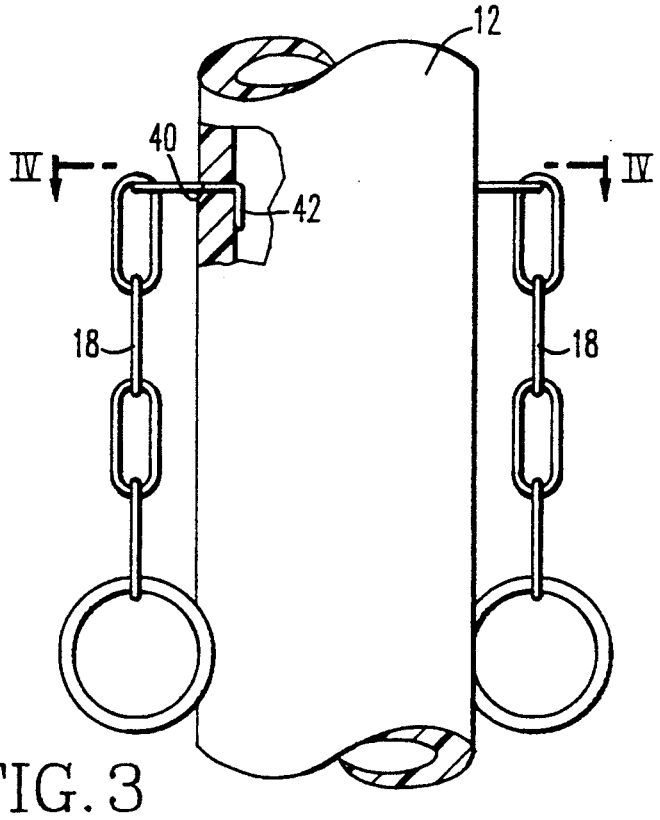
FIG. 3

GOLF-CLUB HOLDER FOR USE WITH GOLF CARTS

BACKGROUND OF THE INVENTION

1. Field of the Invention

This invention relates to golf-club holders and, more particularly, to golf-club holders which are particularly adapted for use with golf carts.

2. Description of the Prior Art

Golf carts are a very popular commodity and their popularity is increasing. The carts are often restricted to golf-cart paths particularly in the vicinity of the greens. Most golf carts are used by a pair of golfers, either as a single or foursome, with the golf bags strapped on the back of carts. It frequently occurs that one of the pair of golfers drives a ball to one side of the fairway or green and the other golfer drives the ball to the other side of the fairway or green. In such case, one of the golfers normally removes one or more clubs from his bag and hand carries them to the location of his ball while the other golfer drives the cart to his ball.

More often than not, the golfer who carries the clubs to the ball is not sure just what club he will decide to use so he hand carries the multiple clubs. Particularly in the vicinity of the green, the golfer will normally hand carry one or more short irons and a putter to the location of the ball. When making the shot, the golfer will usually lay the unused club on the ground and then pick same up when the shot is completed. This is a source of trouble for the golfer sometimes has so concentrated on the shot that he inadvertently leaves a club on the course, sometimes in tall grass. The same trouble occurs in the vicinity of the green when the golfer utilizes his putter and leaves the other club, such as a short iron, lying in the approaches or fringes of the green. Laying the unused club on the ground also exposes the unused club to moisture and dirt requiring cleaning before the club can be used.

While no statistics are available, it is believed that the majority of golfers who use carts have experienced the total and complete frustration that accompanies the realization that a club has been inadvertently left somewhere on the course and many golfers have made this same mistake more times than they will admit.

Small hand-carried golf-club holders have been known and used for many years. Most of these have in the use of a blade or spike protruding from one end portion which the golfer inserts into the ground to leave the holder in upright position while he makes his shot. An early patent such a device is No. 699,391 dated May 6, 1902 to Johnson wherein the club shafts are retained at the bottom and top portions of the holder by laterally projecting discs and sockets. No. 2,577,333 dated Dec. 4, 1951 to Klum et al. also discloses projecting retaining members at the top and bottom portion of the holder to retain the clubs. No. 2,716,432 dated Aug. 30, 1955 to Duffy retains the clubs at the top portion only of the club holder which is held upright by a laterally projecting spike. No. 2,858,868 dated Nov. 4, 1958 uses a rigid laterally projecting member positioned toward the top of the club carrier to retain the clubs with the head portions of the clubs retained by a flexible strap which encircles the shafts. No. 2,887,137 dated May 19, 1959 to Robb uses a laterally projecting slotted retainer to hold the grip portions of the clubs.

SUMMARY OF THE INVENTION

There is provided a golf-club holder which can be carried as a supplement to a golf bag for use when the golfer wishes to hand carry several clubs to the general location of the ball out on the course and the golfer wishes to insure that the club or clubs ultimately not selected for the golf shot are maintained in a clean and dry condition and will not inadvertently be left on the course.

The holder comprises an elongated rigid body member one end of which comprises the bottom portion and is formed as a spike. To use the holder, the body member is adapted to have sufficient downward pressure applied thereto to drive the spike into the ground to maintain the holder in an upright position.

A golf-club-retaining means is affixed to the body member and is spaced a predetermined distance from the spike as determined by the lengths of the shaft portions of the club to be retained. The club-retaining means comprise at least one elongated flexible member of relatively short length affixed at one end thereof to the body member with the other end being freely movable. The movable end has affixed thereto a club-retaining device which overfits the club shaft proximate the upper or grip portion thereof with the remainder of the club extending downwardly therefrom. The flexible nature of the retaining means readily permits the golf-club holder to be stored in the golf bag when not in use since very little lateral space is occupied by the holder placed in the bag.

BRIEF DESCRIPTION OF THE DRAWINGS

For a better understanding of the invention, reference should be made to the accompanying drawings wherein:

FIG. 3 is a fragmentary enlarged view, shown partly in section, of the portion of the shaft body of the golf-club holder showing a pair of the golf-club-retaining means;

FIG. 4 is a sectional view taken on the lines IV—IV in FIG. 3 in the direction of the arrows showing how the short flexible members are/retained on the body portion of the holder;

FIG. 5 is an elevational view of a conventional golf bag with the present golf-club holder retained therein.

DESCRIPTION OF THE PREFERRED EMBODIMENTS

Figure 1:
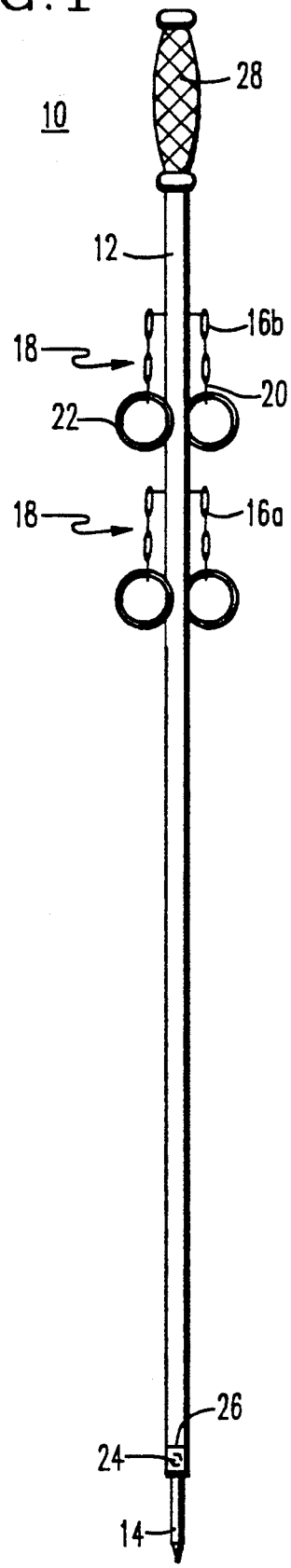
FIG. 1 is an elevational view of the present golf-club holder.

The present golf-club holder 10 is shown in FIG. 1 and comprises an elongated rigid body member 12 with the bottom portion thereof terminating in a spike 14. To use the holder 10, the body 12 is adapted to have sufficient downward longitudinal force applied thereto to drive the spike 14 into the ground to maintain the holder 10 in an upright position.

Golf-club-retaining means **16*a* and 16*b* are affixed to the body member 12 and are spaced a predetermined distance from the spike 14 as determined by the length of the shaft portions of the clubs to be retained. The club-retaining means comprise at least one elongated flexible member 18 of relatively short predetermined length affixed at one end thereof to the body member 12 with the other end 20** being freely movable. To the movable end 20 is affixed a golf-club-retaining device 22 which is adapted to retain a golf club proximate the upper portion with the remainder of the club shaft portion and the club head portion extending downwardly therefrom. The spike 14 is secured to the body member 12 by epoxy resin and a pin 24 which is with a decorative end cap 26. The top portion of the body member 12 is provided with an overfitting hand grip 28.

Figure 2:
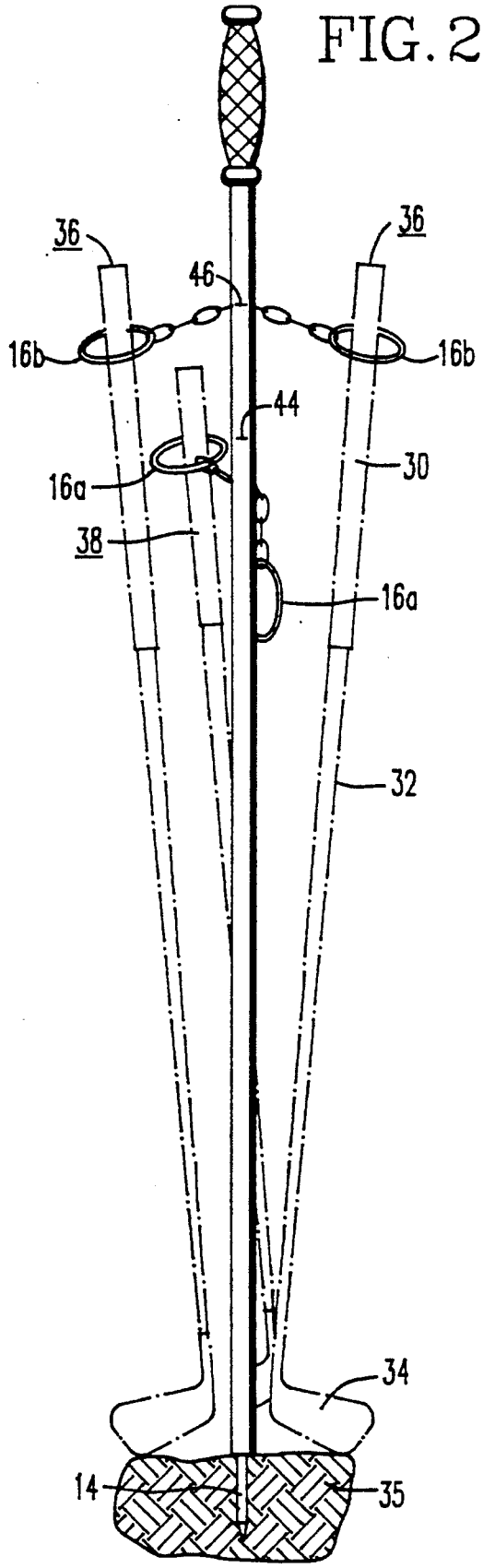
FIG. 2 is an elevational view of the holder in a club-retaining mode, as actually used on the course.

The present holder in use on a golf course is shown in FIG. 2. The retained clubs, shown in broken lines, are conventional and comprise a grip portion 30, a portion 32 and a head portion 34. The spike 14 has been driven in the ground 35 to retain the holder 10 in an upright position which preferably approximates the vertical. In the embodiment as shown, two longer irons 36 are retained by the uppermost retaining means 16*b*. The shorter retained club 38, such as a short iron or a putter, is retained by a lower retaining means 16*a*. The head portions 34 of the retained clubs rest on the ground and the grip portions 30 thereof are elevated and free from contact with dirt and moisture.

Details for securing the flexible members 18 to the body 12 are shown in FIGS. 3 and 4. The flexible member 18 are preferably formed as a brass link chain with the links measuring about one-half inch by one-quarter inch (1.3cm×0.64cm). The material comprising the links has a diameter of about one-eighth inch (0.32cm). One of the links is straightened out and inserted through a hole 40 in the body member and then peened flat against a temporary mandrel inserted into the body 12. This provides a secure attachment 42 for the affixed end of the flexible members 18, see FIG. 3 and FIG. 4.

Following are specific details for the present golf-club holder 10. The body member 12 is formed of heavy wall CPVC tubing with a total length of 40 inches (101.6cm) and an outer diameter of five-eighths inch (1.59cm) and the spike is aluminum with a length of 4 inches (10.2cm). Both of these members could be plated steel or other material, if desired. The longitudinal spacing between the retaining means 16*a* and 16*b* and the spike 14 is determined by the lengths of the club shaft. Desirably, the retaining devices 22 fit about the club grips 30 about two to five inches from the top of the retained club. Putter lengths vary from 30 to 35 inches (76.2cm to 88.9cm). Short irons vary from 32 to 37 inches (81.3cm to 94cm). Long irons can be up to 40 inches (101.6cm). Woods are about 44 inches (111.8cm). In its preferred form, the holder 10 has two pairs of club retaining means 16*a* and 16*b*. The lower set comprises two of these elements 16*a* placed about one peripheral portion 44 of the body member 12 to accommodate the shorter clubs, shown as dashed line in FIG. 2. The upper set comprises two of these elements 16*b* placed about a second peripheral portion 46 of the body member 12 to accommodate the longer clubs, shown as a dashed line in FIG. 2. As a specific example, the lower set of retainers 16*a* is secured to the body member 12 at a distance of about 34 inches (86.4cm) from the spike 14 and the upper set of retainers 16*b* is secured to the body 12 at a distance of about 36.2 inches (91.9cm) the spike 14.

The retaining device 22 is formed of neoprene rubber similar to an O-ring with a diameter of 1.25 inch to 1.5 inch (3.18cm to 3.8cm) with a material diameter of one eighth inch (0.32cm).

In FIG. 5 is shown an elevational view of a golf bag 48 with the present holder 10 stored therein for as a supplement to the golfer who uses a cart. The convention bag-stored golf clubs are not shown. In its preferred form, the top of the grip portion 28 of the stored holder 10 will be about even with the head portion of the longest clubs so that the holder is readily available for the user.

In its preferred form, the relatively short flexible members 18 are formed as a chain link which provides a maximum of both flexibility and strength. Other flexible materials can be substituted therefor. Alternatively members 18 could be fabricated as a freely movable arms hinged at the top portion thereof to the body 12 with the golf-club retaining devices affixed to the other, movable ends thereof. In all embodiments, when the rigid body member 12 is in a vertical orientation, the golf-club-retaining means 16*a* and 16*b* will hang down in an orientation which generally parallels the rigid body member so that the lateral space occupied by the golf-club holder 10 is relatively small and the holder is readily inserted into the golf-club holder for use as needed.

I claim as my invention:

1. A golf-club holder which can be carried as a supplement to a golf bag for use when golfer wishes to hand carry several clubs to the general location of the ball out on the course and the golfer wishes to insure that the club or clubs ultimately not selected for the golf shot are maintained in a dry and clean condition and will not inadvertently be left on the course, the golf clubs for which the holder is designed to be used are conventional in design and comprise the usual shaft portion, grip portion and head portion, said golf-club holder comprising:

an elongated rigid body member, one end of said rigid body member comprising the bottom portion thereof which terminates in a retaining spike means, the other end of said rigid body member comprising the upper portion thereof, and in order to use said holder said rigid elongated body member is adapted to have sufficient downward longitudinal force applied thereto to drive said spike means into the ground to maintain said holder in an upright position; and golf-club-retaining means affixed said rigid elongated body member and spaced a predetermined distance from said spike means as determined by the length of the shaft portions of the clubs desired to be retained, said club-retaining means comprising at least one elongated flexible movable member of relatively short predetermined length affixed at one end thereof to said elongated body member with the other end thereof being freely movable, the freely movable end of said movable member having affixed thereto a golf-club-retaining device which is adapted to retain the golf club proximate the upper portion thereof the remainder of the club shaft portion and club head portion extending downwardly therefrom; whereby the grip portions of the retained clubs are not subject to getting moist or dirty and the visible upright nature of the functioning golf-club holder minimizes the chances of mistakenly leaving or losing on the course any of the retained clubs, and the flexible movable nature of said golf-club-retaining means readily permits the golf-club holder to be stored in the golf bag when not in use, if desired.

2. The golf-club holder as specified in claim 1, wherein said golf-club-retaining means is formed as a flexible chain-type member affixed at one end to said rigid body member and having affixed to the other movable end thereof said club-retaining device.

3. The golf-club holder as specified in claim 2, wherein said club-retaining device is formed as a ring-shaped member formed of somewhat resilient composition to enable the retaining device to be easily fitted over the upper end of the club and the grip portion of the club to retain the club in a position which is upright with respect to the ground.

4. The golf-club holder as specified in claim 3, wherein the dimensions of said ring-shaped member are predetermined so that it readily slips over the upper end of the club and the grip portion of the club.

5. The golf-club holder as specified in claim 1, wherein retained clubs have the head portions resting on the ground.

6. The golf-club holder as specified in claim 1, wherein the upper portion of said rigid body member comprises a hand-gripping means to facilitate handling said golf-club holder.

7. The golf-club holder as specified in claim 1, wherein several of said golf-club-retaining means are provided and are affixed to said rigid body member about the periphery thereof.

8. The golf-club holder as specified in claim 1, wherein more than one of said golf-club-retaining means are provided and are affixed to said rigid body member with a predetermined longitudinal spaced therebetween in order to effectively retain golf clubs of different lengths.

9. The golf-club holder as specified in claim 1, wherein when said rigid body member is in a vertical orientation and no golf clubs are operatively retained by said holder, said golf-club-retaining means hang down in an orientation which generally parallels said rigid body member, whereby the lateral space occupied by said golf-club holder is relatively small and said golf-club holder is readily inserted into a golf bag to be available for use when needed.

10. A golf-club holder which can be carried as a supplement to a golf bag for use when the golfer wishes to hand carry several clubs to the general location of the ball out on the course and the golfer wishes to insure that the club or clubs ultimately not selected for the golf shot are maintained in a dry and clean condition and will not inadvertently be left on the course, the golf clubs for which the holder is designed to be used are conventional in design and comprise the usual shaft portion, grip portion and head portion, said golf-club holder comprising:

an elongated rigid body member, one end of said rigid body member comprising the bottom portion thereof which terminates in a retaining spike means, the other end of said rigid body member comprising the upper portion thereof which is formed as a hand-grip means, and in order to use said holder rigid elongated body member is adapted to have sufficient downward longitudinal force applied thereto to drive said spike means into the ground to maintain said holder in an upright position; and golf-club-retaining means affixed to said rigid elongated body member and spaced a predetermined distance from said spike means as determined by the length of the shaft portions of the clubs desired to be retained, said club-retaining means comprising elongated flexible members of relatively short predetermined length affixed at one end thereof to said elongated body member with the other ends thereof being freely movable, the movable ends of said flexible members having affixed thereto ring-shaped golf-club-retaining devices which are adapted to readily slip over the upper ends of the clubs and onto the club grip portions to retain the golf clubs proximate the upper portions thereof with the remainder of the club shaft portions and club head portions extending downwardly therefrom with the golf club head portions resting on the ground; whereby the grip portions of the retained club are not subject to getting moist or dirty and the visible upright nature of the functioning golf-club holder minimizes the chances of mistakenly leaving or losing on the course any of the retained clubs, and the flexible nature of said relatively short club-retaining means minimizes the lateral space occupied by the golf-club holder when placed in a vertical position which readily enables the golf-club holder to be stored in the golf bag when not in use.

11. The golf-club holder as specified in claim 10, wherein said ring-shaped club-retaining devices are formed of somewhat resilient composition to enable the retaining devices to be easily fitted over the upper club ends and the grip portions.

12. The golf-club holder as specified in claim 10, wherein at least two of said relatively short club-retaining means are provided and are affixed to said rigid body member about a peripheral portion thereof.

13. The golf-club holder as specified in claim 10, wherein at least four of said relatively short club-retaining means are provided and are affixed to two different peripheral portions of said rigid body member with a predetermined longitudinal spacing between the two different peripheral portions in order to effectively retain golf clubs of different lengths.

* * * * *